United States Patent [19]

Barillec et al.

[11] Patent Number: 4,563,861

[45] Date of Patent: Jan. 14, 1986

[54] METHOD OF PACKING COLLECTED OBJECTS AND PACKING STATION THEREFOR

[76] Inventors: Christian Barillec, 325 boulevard Gambetta, Tourcoing (Nord); Dominique Janvier, 31 Avenue de la Roseraie, Lille (Nord); Marc Bonneton, 325 boulevard Gambetta, Lille (Nord), all of France

[21] Appl. No.: 578,863

[22] Filed: Feb. 10, 1984

[30] Foreign Application Priority Data

Nov. 29, 1983 [FR] France ..... 83 19255

[51] Int. Cl.[4] ..... B65B 47/10

[52] U.S. Cl. ..... 53/453; 53/463; 53/464; 53/504; 53/559

[58] Field of Search ..... 53/247, 268, 447, 453, 53/463, 464, 466, 501, 504, 556, 559, 525; 414/82

[56] References Cited

U.S. PATENT DOCUMENTS

| | | | |
|---|---|---|---|
| 2,289,668 | 7/1942 | Mallory | 53/453 |
| 2,836,941 | 6/1958 | Hultkrans et al. | 53/453 |
| 3,104,506 | 9/1963 | Rondin | 53/453 |
| 3,443,356 | 5/1969 | Hani | 53/559 |
| 3,475,877 | 11/1969 | Fuller et al. | 53/525 |
| 4,008,554 | 2/1977 | Hardy | 53/453 |

*Primary Examiner*—John Sipos
*Assistant Examiner*—Donald R. Studebaker
*Attorney, Agent, or Firm*—Robert E. Burns; Emmanuel J. Lobato; Bruce L. Adams

[57] ABSTRACT

This invention relates to a method of packing collected objects having different shapes and volumes, and to a packing station therefor. The method consists in assembling beforehand the objects to be dispatched in a container having a retractable bottom; the container is lowered towards an open-top chest covered with a plasticized film. The bottom of the container is removed so that the objects bear directly upon the plasticized film, whereafter vacuum is created in the inner volume of the chest in order to alter the shape of the plasticized film and thus lower the top level of the objects. Then the container is removed in turn and a rigid support is laid upon the objects and bonded to the plasticized film at the level of the flange of the aperture; finally, the vacuum is discontinued in the chest for releasing the package thus obtained. This invention is applicable more particularly to the mail order industry and the dispatching of goods in general.

7 Claims, 7 Drawing Figures

METHOD OF PACKING COLLECTED OBJECTS AND PACKING STATION THEREFOR

BACKGROUND OF THE INVENTION

1. Field of the Invention

The present invention relates to a method of packing collected objects and also to a packing station for carrying out this method.

This invention is directed more particularly to the mail order industry in which miscellaneous articles having different shapes and volumes are collected and subsequently dispatched.

According to the specific orders received from each customer, the parcels or packages may comprise many different articles or objects and a variable number of them, so that any standardization of the packings is precluded.

This problem is particularly difficult to solve since according to the volume of the parcels to be sent off it will be necessary to dispatch them by a specific transport system, for example by mail, railway or truck. Transport costs are quite variable according to the transport system implemented and in most instances delivery by post seems to be the best answer for obvious economical reasons.

2. The Prior Art

Up to now, in the mail order industry packages consist mainly of cardboard boxes. Storemen select a box size consistent with the volume of the collected articles to be sent off. As a rule, the box has necessarily a size in excess of actual requirements since it is not possible to keep in store a complete range of box sizes suitable for all specific cases that may arise.

The empty spaces left in the box are filled up with lumps of polystyrene or puffed foam, or the like.

The necessity of selecting a box oversized in comparison with the actual volume of the articles leads sometimes to the use of an expensive transport system, whereas if it had been possible to pack the contents in a box of adequate dimensions a more economical transport system could have been used.

Various attempts have been made with a view to pack the articles to be shipped in a thermo-retractable plastic film. This packing adapts itself particlarly well to the objects to be sent off, irrespective of their shape and volume; however, the use of this type of packing is definitely precluded for sending fragile objects, notably on account not only of the pressure exerted on the object during the shrinking of the thermo-retractable plastic film but also of the heat to which the whole contents are subjected when removing the plastic film.

On the other hand, the use of a conventional plastic film packing proved to be unadvisable for certain objects such as suits, dresses, garments or other articles likely to be rumpled during the transport, so that these articles must preferably be packed in means having a certain rigidity so that the article enclosed therein can preserve a certain firmness and cannot be folded during the delivery.

SUMMARY OF THE INVENTION

It is the primary object of the present invention to provide a method of packing collected objects having various shapes and volumes, this method being readily adaptable to any shapes and volumes of the products to be packed while having a certain rigidity notably such that objects likely to be rumpled can travel under satisfactory conditions without any risk of being folded induly. This packing method is particularly suitable for the mail order industry since substantially each sending is governed by the order received from the customer and consequently packing means of variable volumes must be at hand.

Besides, the packing method of the present invention can easily be operated in series, notably with the assistance of the packing station according to this invention for carrying out this packing method. The packing station according to this invention is specially designed for automatic operation.

Moreover, the packing size meets the requirements of dispatching by mail so that the mailing expenses are minimized.

It is another object of the present invention to provide a packing method adapted to be implemented irrespective of the specific nature of the objects to be dispatched, and more particularly the method of this invention is applicable even to fragile objects since the stress to which these objects are subjected is extremely moderate.

In addition, the objects to be packed are stowed very efficiently and all wedging and filling means such as puffed foam or expanded polystyrene as normally used in the mail order trade can safely be dispensed with when using the method of this invention.

Other objects and advantages of the present invention will appear as the following description proceeds, it being clearly understood that this description is given by way of illustration, not of limitation.

The method of packing collected objects having different shapes and volumes, notably for mail dispatching purposes, said objects being previously collected in a container, is characterized in that:

the container is lowered upon the open top side of a chest or box which is previously covered with a sheet of deformable material, the bottom of the container is retracted so that the objects contained therein are supported by the sheet of deformable material, the sheet is allowed to undergo a distortion according to a concave contour consistent with the volume and shape of the objects, the sheet and its contents are covered with a substantially rigid support, the sheet and the support are assembled along the outer periphery of the objects contained therein, and the sheet is cut or trimmed for releasing the package thus obtained.

The packing station for carrying out the method of this invention is characterized in that it comprises:

an open-top chest or box covered by a laminated sheet and further provided with means for deforming the sheet, and a movable container holding the objects to be packed in its bottom and adapted to cover the top opening of the chest or box, said bottom being retractable.

In order to afford a clearer understanding of the present invention reference will now be made to the attached drawing.

THE DRAWING

FIGS. 1*a* to 1*g* illustrate diagrammatically the various steps of the method of packing collected objects of various shapes and sizes, the method being carried out at a packing station according to a preferred form of embodiment of the invention.

DESCRIPTION OF THE PREFERRED EMBODIMENT

The packing method according to this invention is intended more particularly for the mail order trade or industry. In this particular industry, it is currently required to dispatch to customers a plurality of miscellaneous articles or objects which differ for each customer and each sending. Under these conditions, it is particularly difficult to provide a package type well adapted to each specific case.

Conventional packages are rigid, i.e. plastic films and thermoretractable films are ill suited for the job on account of their lack of stiffness so that textiles for example might get rumpled during the transport.

On the other hand, rigid packages such as cardboard boxes, as mentioned in the preamble of the present specification, have compulsorily an internal volume greater than that required, hence the necessity of adding filling material such as puffed foam or expanded polystyrene.

According to the method of this invention there is provided a packing for collected objects of various shapes and volumes, which packing not only is the best adapted to the shapes and volumes of the objects to be dispatched but has furthermore a rigidity sufficient to prevent the rumpling of certain articles such as, for example, textiles, clothes, garments, etc. during their transport.

FIGS. 1*a* to 1*g* illustrate diagrammatically the various steps of the packing method of this invention and afford a clearer understanding of the invention.

Figure 1A:
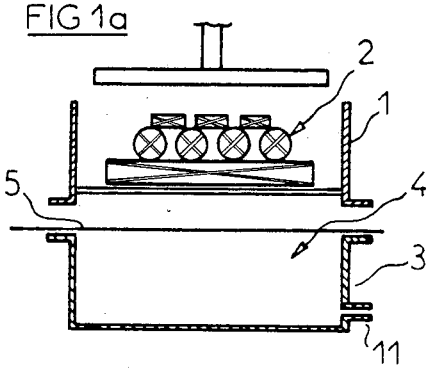

FIG. 1*a* shows a container 1 into which the objects 2 to be dispatched are collected. These objects 2 correspond to the order received from one customer.

The means for handling the container 1 are not shown. However, conventional means such as a conveyor belt or the like may be used for this purpose.

According to the method of the invention, the container 1 is lowered upon the top of a chest 3 having an open top 4 covered with a plasticized film 5. The means implemented for tensioning this plasticized film 5 are conventional and therefore well known to those conversant with the art.

Figure 1B:
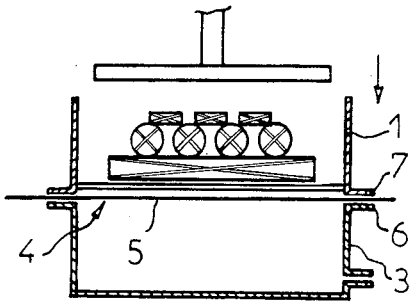

Preferably, the geometrical configuration of this chest 1 is adapted to that of the top opening 4 of chest 3 so that, when the container 1 is laid upon the chest 3 as shown in FIG. 1*b*, it covers completely the upper aperture 4 of chest 3.

Also preferably, this chest 3 is provided along its outer periphery with a flange 6 adapted to support the container 1. The container 1 may advantageously comprise a lower flange 7 adapted to bear on the flange 6 of container 1 in order to ensure a perfect continuity in the mutual contact between the container 1 and chest 3, the plasticized film 5 being disposed between said flanges 6 and 7, which are preferably flat.

The plasticized film 5 is thus somewhat clamped between the container 1 and chest 3.

Figure 1C:
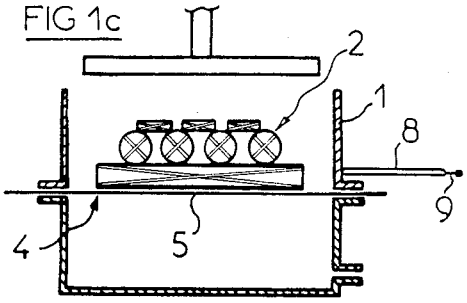

According to the method of the instant invention, the bottom 8 of container 1 is subsequently retracted so that the objects 2 contained in the container 1 rest upon the plasticized film 5, as shown in FIG. 1*c*.

This retraction of the container bottom 8 according to the present invention is obtained by pulling this bottom 8 laterally, as shown diagrammatically by the arrow 9 in FIG. 1*c*.

Figure 1D:
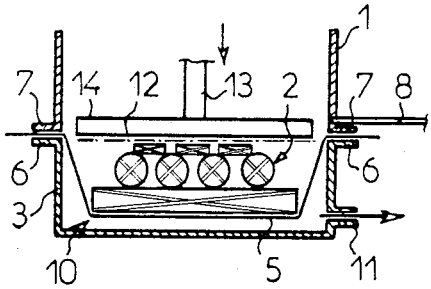

At the end of this step, a certain vacuum is generated in the inner space 10 of chest 3, as shown in FIG. 1*d*. This vacuum may be obtained for instance by connecting the chest 3 to suction means (not shown) through a pipe 11. This vacuum is attended by the distortion of the plasticized film 5 of which the top surface is exposed to the atmospheric pressure and also to the weight of the articles 2. Thus, the plasticized film 5 assumes a concave configuration in which the objects 2 are nested. Since the plasticized film 5 was previously pressed against the flange 6 of chest 3, notably as a consequence of the pressure exerted by the flange 7 of container 1, a sufficient tightness is obtained along the periphery of the aperture 4 and of the plasticized film 5.

According to a preferred form of embodiment of the method of this invention, the suction is discontinued when the topmost level 12 of the objects 2 to be packed corresponds to the level of the container flange 6. Thus, the various objects to be packed will be included in the chest 3 without projecting above the top aperture 4 of this chest.

Though the suction is discontinued within the inner space 10 of chest 3, the vacuum is maintained so that the plasticized film 5 remains in the same condition. The vacuum generated in the inner space 10 also assists in constantly pressing the plasticized film 5 against the flange 6 of chest 3.

The topmost level 12 of the upper portions of the collected objects 2 may be checked for example by means of a sensor 13 adapted to be lowered for engagement with said upper portions and thus detect their level. However, this engagement between the sensor 13 and the objects should be very light, to avoid any stress therebetween. The only function of this sensor 13 is to check the level of, not to apply any force to, the objects 2. Other means such as photo-electric cell may be contemplated if desired for controlling the level 12. Nevertheless, a sensor 13 having a surface 14 corresponding substantially to the geometrical contour of the aperture 4 of chest 3 is more advisable since the volume and configuration of the assembled objects 2 may vary considerably from one package to another.

Figure 1E:
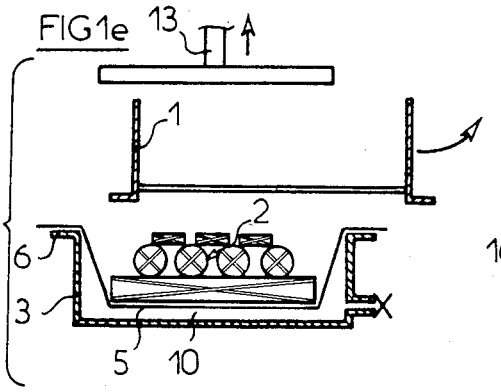

When the topmost level 12 corresponding to the upper portion of the objects 2 to be packed is flush with the flange 6 of chest 3 and the suction in the inner space 10 has been discontinued, the sensor 13 and the container 1 are removed, as shown in FIG. 1*e*. The vacuum is also maintained in the inner space 10 of chest 3, so that the plasticized film 5 keeps adhering to the flange 6 of chest 3 and the objects 2 are held in position in the concave configuration assumed by the plasticized film 5.

This plasticized film 5 and the objects 2 are subsequently covered with a rigid support 14, for example a cardboard sheet. The support 14 may be flat, since the topmost level 12 of the objects 2 is flush with the flange 6 and therefore the rigid support 14 is also flush with the objects 2. It will be seen that this property of support 14 of positioning itself flush with the objects 2 is obtained irrespective of the shape and volume of these objects 2. During the next step of packing process the plasticized film 5 and the rigid support 14 are assembled permanently along the periphery of the aperture 4 of chest 3. The plasticized film 5 and the cardboard support 14 are assembled along a continuous joint 15 surrounding the objects 2.

Figure 1F:
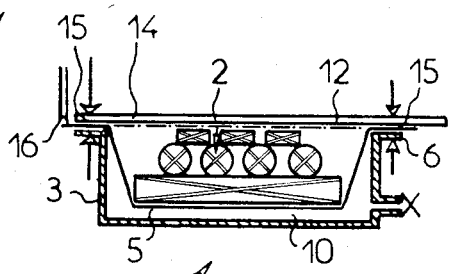

The plasticized film 5 may then be cut or trimmed along the outer periphery of chest 3, for example as shown diagrammatically at 16 in FIG. 1*f*.

Figure 1G:
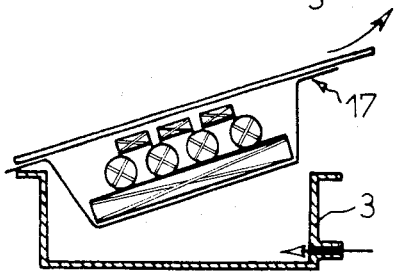

After trimming the plasticized film the atmospheric pressure may be restored in the inner space 10 of chest 3 as shown in FIG. 1*g*, whereafter the package can be removed from the chest.

It will be seen that throughout the packing operation the objects 2 to be packed have not been exposed to any stress or pressure; besides, the plasticized film 5 adapts itself to the geometrical contours and volume of the objects 2 to be packed, and finally the package itself has a certain rigidity due to the presence of the top support 14.

Practical tests proved that the objects 2 should desirably be placed in the container 1 as a function of their volume and shape by disposing the flat and large-sized articles in the bottom, then the large loose goods having a relatively large volume, notably in the thickness direction, and finally the small objects constituting the small loose goods. Just before lowering the container 1 into the chest 3, the container 1 may be vibrated to facilitate the stowing of the objects 2 by filling the gaps with the smallest objects.

The packing station according to a preferred form of embodiment of the invention for carrying out the method disclosed hereinabove comprises a chest 3 having an open top 4 covered with a plasticized film 5, this chest being furthermore connected to a vacuum pump, for example by means of a pipe 11.

The packing station according to this invention further comprises a movable container 1 containing the objects to be packed; the bottom 8 of this container 1 is retractable and adapted to cover the top aperture 4 of chest 3.

To accelerate the packing operation the bottom 8 of container 1 may consist of two half-grids or rows of bars adapted to move away from each other so that the contents 2 can slide down onto the plasticized film 5. By using a bottom divided into two halves the retraction is much faster since both portions can be actuated simultaneously with opposite motions.

It is also apparent that the packing method and station according to the present invention can easily be operated automatically since it is unnecessary to resort to any manual interventions.

Moreover, by selecting a cardboard support 14 slightly oversized with respect to the plasticized film 5, it is possible to provide in this support 14 a handle-forming cut-up portion. Besides, a label mentioning the name and address of the consignee may be affixed to the rigid support 14.

In case fragile objects have to be dispatched, the bottom of container 1 may advantageously be lined with a layer of protection foam, so that this layer will cover the outer surface of the package 17, or as an alternative the foam layer may be disposed initially upon the film 5.

In addition, an opaque plasticized film 5 may advantageously be used for preserving the anonymity of the contents during the transport.

Since the distortion of the plasticized film 5 is pratically zero during the step corresponding to FIG. 1*b*, any upsetting of the articles is safely precluded.

In the foregoing it is contemplated to bond the plasticized film 5 to the cardboard support 4 by welding; however, it is obvious that other fixing methods could be used, notably the use of a suitable adhesive.

Other forms of embodiment of the present invention, within the skill of anybody conversant with the art may be contemplated without departing from the basic principles of the invention.

Thus, more particularly, it is also admitted that certain articles might protrude slightly beyond the flange 6 of chest 3 when a certain vacuum has been produced in said chest. In this case, the sensor 13 may exert a certain yet moderate force, or if possible and necessary a certain pressure may be exerted on the objects 2 in order to stretch the plasticized film 5. With this procedure the objects are better held in the package.

The distortion of the plasticized film may also be obtained not by means of a vacuum generated in the chest 3 but rather by means of an overpressure exerted against the top surface of the film.

More generally, the method of the present invention is applicable with a sheet of deformable material which may consist for example of a plasticized film or also a net which is caused to assume the concave configuration consistent with the volume, shapes and specific nature of the objects to be packed. This distortion may be obtained through different means and methods, notably by using a variable pressure in the case of a continuous film or by resorting to mechanical means for example in the form of hooks engaging the net meshes and exerting a tractive effort thereof for bringing about the net distortion.

What is claimed is:

1. Apparatus for packaging objects of various shapes and sizes, comprising:

a container open at the top to receive objects to be packaged and having a peripheral edge and a bottom which is removable laterally, and a chest open at the top and having a peripheral wall with an upper peripheral edge of a size and shape to support the lower peripheral edge of said container with a plasticized plastic film between the upper peripheral edge of said chest and lower peripheral edge of said container, a bottom and means for applying suction to said chest, after a container containing objects to be packaged is placed on said chest and the bottom of said container is removed laterally to deposit said objects on said plasticized plastic film, to draw said film down into said chest until said objects are within said chest, whereupon said container is removed and a rigid support is placed over said object and bonded to peripheral portions of said film, further comprising means for sensing the uppermost portion of said objects when said plasticized film with said objects thereon is drawn down into said chest by said suction means, said sensing means comprising a sensor positioned over said objects and means for lowering said sensor into contact with uppermost portions of said objects and then raising said sensor before said support is placed over said objects.

2. Apparatus according to claim 1, in which said container has a flange at its lower peripheral edge and said chest has at its upper peripheral edge a flange for supporting said film.

3. Apparatus according to claim 1, in which said means for lowering said sensor brings said sensor into contact with said objects without substantial pressure.

4. A method of packaging objects of various shapes and sizes which comprises the steps of:

placing said objects in a container having an open top to receive said objects, a peripheral wall having a lower peripheral edge, and a bottom removable laterally from the container, placing said container having said objects therein on a chest open at the top and having a peripheral wall with an upper peripheral edge of a shape and size to receive said lower peripheral edge of said container and a closed bottom, said container being placed on said chest with a plasticized plastic film between the lower peripheral edge of said container and the upper peripheral edge of said chest, removing the bottom of said container laterally from the container whereby said objects rest on said film, applying suction to said chest to draw said film toward the bottom of said chest until uppermost portions of said objects are within said chest.

removing said container, placing a support over said chest and bonding it to a peripheral portion of said film supported by said upper peripheral edge of said chest, and sensing the uppermost portion of said objects when said film is drawn into said chest to determine that said objects are within said chest, the level of the uppermost portion of said objects being sensed by lowering a sensor into contact with the uppermost portion of said objects and then removing said sensor before said support is placed over said chest.

5. A method according to claim 4, in which said sensor is brought into contact with the uppermost portion of said objects without applying substantial pressure to said objects by said sensor.

6. A method according to claim 4, in which said support is flat sheet material having sufficient rigidity to maintain said sheet substantially flat.

7. A method according to claim 6, in which after said support is bonded to said film, peripheral edges of said support and film are trimmed.

* * * * *